US012305658B2

(12) United States Patent
Wang et al.

(10) Patent No.: US 12,305,658 B2
(45) Date of Patent: May 20, 2025

(54) PERFORMANCE TEST BENCH DEVICE FOR CENTRIFUGAL COMPRESSOR UNDER VARIABLE WORKING CONDITION OF ENGINE

(71) Applicant: Tianjin University, Tianjin (CN)

(72) Inventors: Tianyou Wang, Tianjin (CN); Lei Shi, Tianjin (CN); Zhen Lu, Tianjin (CN); Kai Sun, Tianjin (CN)

(73) Assignee: Tianjin University, Tianjin (CN)

( * ) Notice: Subject to any disclaimer, the term of this patent is extended or adjusted under 35 U.S.C. 154(b) by 0 days.

(21) Appl. No.: 18/821,091

(22) Filed: Aug. 30, 2024

(65) Prior Publication Data

US 2024/0418175 A1 Dec. 19, 2024

Related U.S. Application Data

(63) Continuation of application No. PCT/CN2023/081341, filed on Mar. 14, 2023.

(51) Int. Cl.
*F04D 27/00* (2006.01)

(52) U.S. Cl.
CPC ..... *F04D 27/001* (2013.01)

(58) Field of Classification Search
CPC ..... F04D 27/001; F04D 17/10; F04D 27/004; F02B 37/00
See application file for complete search history.

(56) References Cited

U.S. PATENT DOCUMENTS

2016/0076549 A1 3/2016 Kelly et al.
2016/0076553 A1* 3/2016 Bessho ..... F04D 29/681 415/204
2017/0122328 A1 5/2017 Himmelmann
(Continued)

FOREIGN PATENT DOCUMENTS

CN 102589894 A 7/2012
CN 104533816 B 8/2016
CN 106499651 A 3/2017
(Continued)

OTHER PUBLICATIONS

First Office Action issued in counterpart Chinese Patent Application No. 202210266187.4, dated Feb. 21, 2024.
(Continued)

*Primary Examiner* — Suman K Nath
(74) *Attorney, Agent, or Firm* — ScienBiziP, P.C.

(57) ABSTRACT

A performance test bench device for a centrifugal compressor under a variable working condition of an engine is composed of: a turbine back disk temperature simulator and the centrifugal compressor being coaxially arranged, and being sequentially connected with a speed regulator and a driver. Meanwhile, a thermocouple array is arranged on a surface of a simulator back plate. A temperature measurement probe is arranged at an inlet and an outlet of the centrifugal compressor, and a thermocouple array is also arranged on a surface of a cover plate of the centrifugal compressor and a surface of a rotating blade. An airflow passes through the inlet pipeline, the flow meter and the air inlet rectification system, is pressurized by the centrifugal compressor, and is then discharged by the outlet pipeline.

2 Claims, 2 Drawing Sheets

(56) References Cited

U.S. PATENT DOCUMENTS

2018/0128274 A1* 5/2018 Wirth ..... F04D 29/053

FOREIGN PATENT DOCUMENTS

| | | | |
|---|---|---|---|
| CN | 207516036 | U | 6/2018 |
| CN | 109813553 | A | 5/2019 |
| CN | 111894882 | A | 11/2020 |
| CN | 112392756 | A | 2/2021 |

OTHER PUBLICATIONS

Notification to Grant Patent Right for Invention issued in counterpart Chinese Patent Application No. 202210266187.4, dated Jun. 28, 2024.

* cited by examiner

PERFORMANCE TEST BENCH DEVICE FOR CENTRIFUGAL COMPRESSOR UNDER VARIABLE WORKING CONDITION OF ENGINE

CROSS-REFERENCE TO RELATED APPLICATIONS

This application is a continuation of International Application No. PCT/CN2023/081341, filed on Mar. 14, 2023, which claims priority to Chinese Patent Application No. 202210266187.4, filed on Mar. 15, 2022. All of the aforementioned applications are incorporated herein by reference in their entireties.

TECHNICAL FIELD

The present disclosure belongs to an engine turbocharger detection technology, and particularly relates to a centrifugal compressor performance detection device.

BACKGROUND

Compared to naturally aspirated engines, turbocharged engines generally suffer from turbo lag. This is primarily due to the fact that the turbocharger is not coaxial with the engine, and when changes occur in the engine's speed or load, the turbocharger's rotational speed response lags behind, resulting in a delay in power changes. To solve the problem of turbo lag, a series of new technologies have been adopted, such as lightweight impellers, compact intercoolers, high-efficiency bearing systems, and electric boosting assistance. With the application of these new technologies, turbochargers are becoming more responsive during engine variable conditions. In the context of developing these technologies, there is an urgent need to establish a test device for the centrifugal compressor when the supercharger is in the transitional state of speed switching. Through the test bench simulation of the spatio-temporal evolution of internal flow within the centrifugal compressor under the transitional state of speed switching, the experimental data of aerodynamic characteristics and internal flow field of the centrifugal compressor in this state are obtained, which provides a theoretical basis and experimental database for the design of high-performance supercharger.

In the current technology of centrifugal compressor test benches, Chinese Patent Publication CN106499651B discloses test device for non-steady characteristics of centrifugal compressor and test method under outlet pulsating flow conditions, the unsteady performance of the centrifugal compressor under the pulsating condition can be obtained, and the single technical problem that conventional centrifugal compressor performance tests can only provide steady-state performance is solved. Chinese Patent Publication CN104533816B provides radial diffuser testing device and testing method of centrifugal compressor. Its beneficial effects lie in its suitability for radial diffuser testing, as well as its capabilities in simulating internal flow within the centrifugal compressor, simulating the influence of geometric factors, and simulating the impact of upstream flow conditions. However, the aforementioned technologies are all conducted under constant rotational speeds for performance or internal flow field testing, failing to reproduce the fundamental characteristics of internal flow and heat transfer within the centrifugal compressor during transitional states under the variable working condition of the engine. This is because traditional aerodynamic test benches for centrifugal compressors solely focus on internal flow and aerodynamic characteristics (such as pressure ratio, efficiency, and flow rate), neglecting the heat transfer process between the compressor and airflow under the variable rotating speed. Consequently, there are significant differences between the measured transient characteristics and the actual transitional state, resulting in a lack of testing capabilities for the aerodynamic characteristics and internal flow field of the turbocharger's centrifugal compressor during rotational speed switching.

SUMMARY

In view of the technical shortcomings of the above-mentioned experimental device, the present disclosure proposes a test bench that displays the performance of the centrifugal compressor under the variable working condition of the engine in real time, which can realize the aerodynamic characteristics and internal flow field of the centrifugal compressor when the rotating speed of the supercharger is switched.

The technical scheme of the device of the present disclosure is as follows.

A performance test bench device for a centrifugal compressor under a variable working condition of an engine comprises an inlet pipeline, a flow meter, an air inlet rectification system, a centrifugal compressor, an outlet pipeline, an exhaust valve, a gearbox, an encoder, a rotating speed feedback control system, a frequency converter, a speed regulator, a heat exchanger, thermocouples, a driver, an alternating current motor and the like. Its components are composed of: the centrifugal compressor is sequentially arranged coaxially with a turbine back disk temperature simulator, the speed regulator and the driver, and a back plate and the heat exchanger are arranged at a front end of the turbine back disk temperature simulator; a thermocouple array is composed of a plurality of pairs of thermocouples, and the thermocouple array is arranged on a surface of the back plate; a total average temperature measurement probe is arranged at an inlet and an outlet of the centrifugal compressor; and the thermocouple array is arranged on a surface of a rotating blade of the centrifugal compressor.

In order to test the performance of the centrifugal compressor, the test bench is provided with a plurality of test points: a first group of total pressure, static pressure and average temperature measurement points are arranged in the inlet pipeline; a second group of total pressure, static pressure and average temperature parameter measurement points are arranged at the outlet of the centrifugal compressor; a wall surface temperature measuring point is arranged at an axial outlet of the centrifugal compressor; and a rotating speed measuring point is arranged at a main shaft inlet of the speed regulator; and thermocouple array measuring points are arranged on the surface of the back plate.

According to the centrifugal compressor, the current power mode of driving the centrifugal compressor by utilizing the waste gas turbine is changed, the speed regulation system composed of the frequency converter and the alternating current motor is adopted, the gearbox and the rotating speed feedback control system connected with the encoder form a driving system, and the rotating speed and the change of the centrifugal compressor are accurately controlled.

As a new structure, a turbine back disk temperature simulation device composed of a heat exchanger and a back plate is adopted to accurately simulate the temperature distribution of the turbine back plate, and the typical characteristics of internal flow heat transfer under the variable rotating speed of the centrifugal compressor are reproduced.

The characteristics and beneficial effects achieved by the present disclosure are as follows.

The present disclosure provides an aerodynamic characteristic test platform and an experimental method for researching a centrifugal compressor under the variable working condition of an engine, the rotating speed change of the centrifugal compressor can be accurately controlled according to set parameters; the temperature of the back plate can be controlled according to set different temperature distribution characteristics to simulate the influence of radiation heat transfer of the turbine back plate on the transient performance and the internal flow field of the compressor during operation of the supercharger. Finally, the typical characteristics of the internal flow heat transfer of the centrifugal compressor when the supercharger rotates at a variable speed are reproduced, and the dynamic performance and the internal flow field of the centrifugal compressor in a transition state are obtained. The test bench is simple in structure, controllable in parameter and convenient to operate, a test platform and a test method which are closer to the real transition state of the supercharger are provided, and an experimental device is provided for performance evaluation of the centrifugal compressor and refined test of the internal flow field under the variable working condition of the engine.

DETAILED DESCRIPTION OF THE EMBODIMENTS

The composition and the test steps of the device are described in detail below with reference to the drawings and the embodiments. Through the measurement process of the dynamic characteristics of the centrifugal compressor under the variable working condition of the engine, the beneficial effects of the centrifugal compressor are described.

Figure 1:
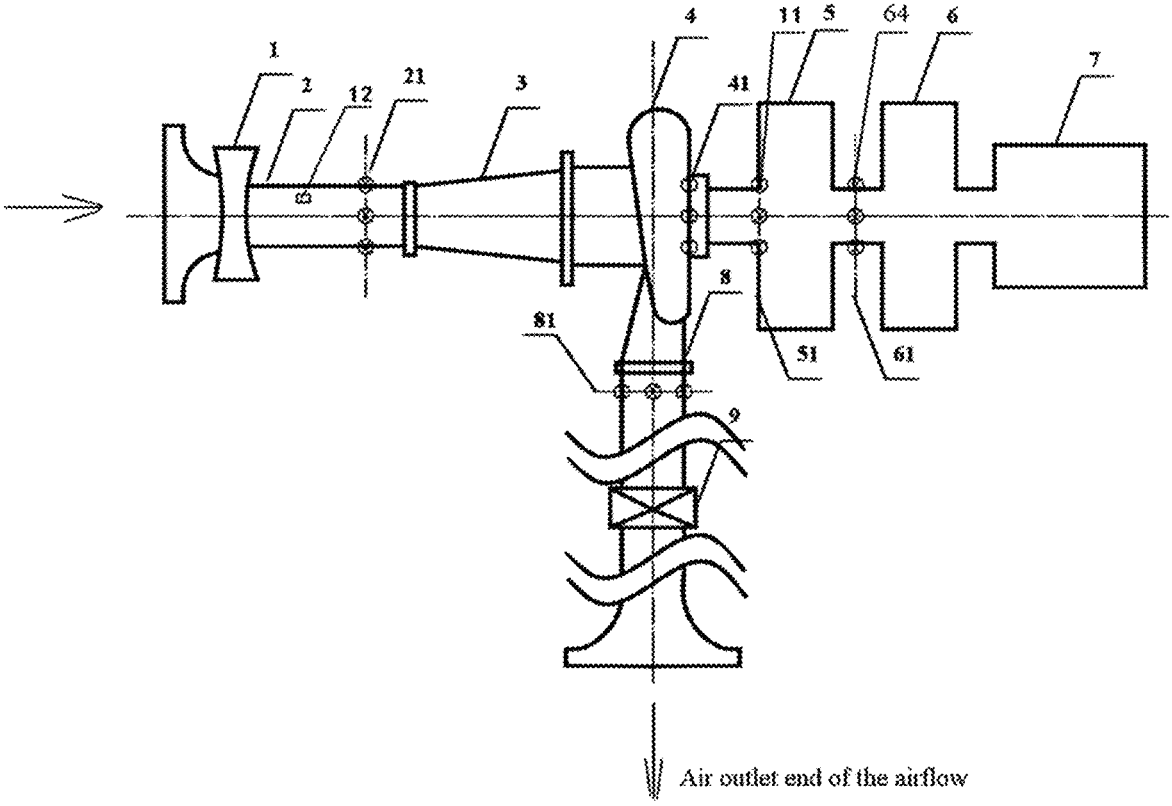
FIG. 1 is a schematic diagram of connecting structures of components of a performance test bench for a centrifugal compressor under a variable working condition of an engine.
Figure 2:
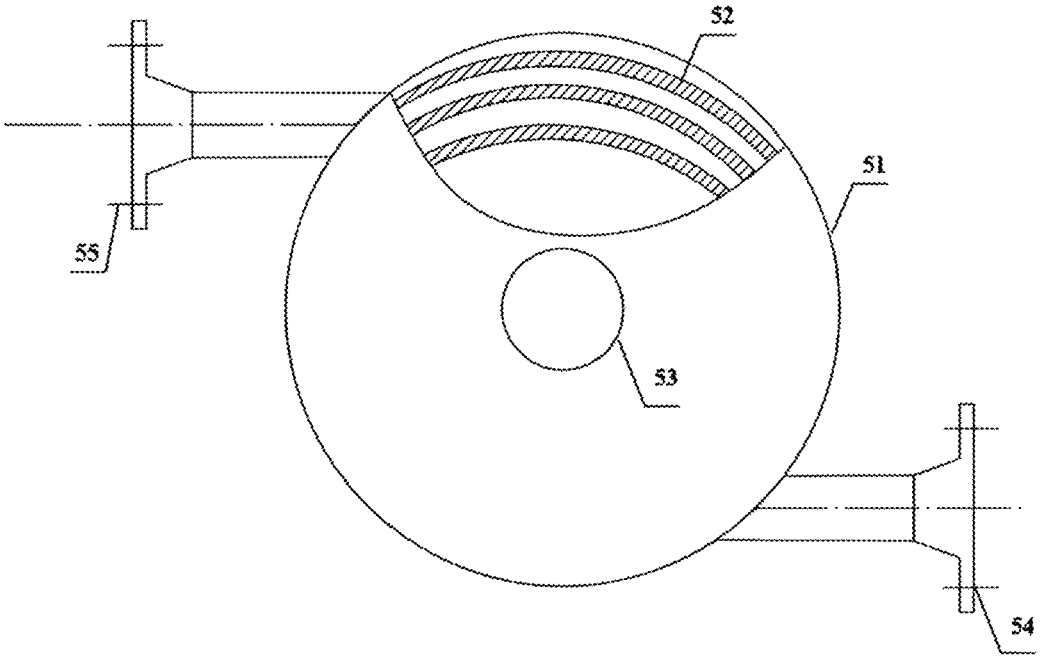
FIG. 2 is a schematic structural diagram of a turbine back disk temperature simulation device on a test bench.

As shown in FIG. 1, the components of a performance test bench device for a centrifugal compressor under a variable working condition of an engine are composed of: the centrifugal compressor 4 is sequentially arranged coaxially with a turbine back disk temperature simulator 5, the speed regulator 6 and the driver 7. As shown in FIG. 2, a back plate 51 and the heat exchanger 52 are arranged at a front end of the turbine back disk temperature simulator 5; a thermocouple array is composed of a plurality of pairs of thermocouples 11, and the thermocouple array is arranged on a surface of the back plate 51; a total average temperature measurement probe 12 is arranged at an inlet and an outlet of the centrifugal compressor 4; and the thermocouple array is arranged on a surface of a rotating blade of the centrifugal compressor 4.

When a test bench works, an airflow sequentially passes through the inlet pipeline 2, the flow meter 1 and the air inlet rectification system 3, is pressurized by the centrifugal compressor 4, and is then discharged by the outlet pipeline 8, and an outlet of the exhaust valve 9 is connected to an air outlet end of the airflow.

Figure 3:
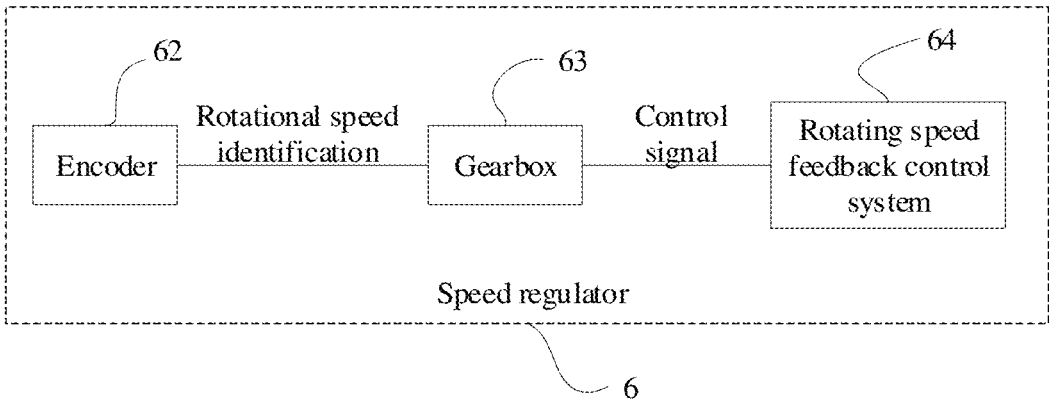
FIG. 3 is a schematic diagram of connecting structures of the governor.

As shown in FIG. 3, the connection method of each component: the speed regulator 6 is composed of the gearbox 63, the encoder 62 and the rotating speed feedback control system 64; the encoder 62 and the rotating speed feedback control system 64 are sequentially connected to a main shaft of the gearbox 63; the driver 7 is coaxially connected to the frequency converter 71 and the alternating current motor 72 in sequence; high-temperature circulating water is connected in the heat exchanger; and a through hole 53 is formed in a center of the turbine back disk temperature simulator 5, and a main shaft of the centrifugal compressor 4 penetrates through the through hole 53.

The measuring points arrangement of the test bench: a first group of total pressure, static pressure and average temperature measurement points 21 are arranged in the inlet pipeline 2; a second group of total pressure, static pressure and average temperature parameter measurement points 81 are arranged at the outlet of the centrifugal compressor; a wall surface temperature measuring point 41 is arranged at an axial outlet of the centrifugal compressor 4; and a rotating speed measuring point 61 is arranged at a main shaft inlet of the speed regulator 6.

The test method corresponding to the test bench device comprises the following steps.

Step 1: opening the exhaust valve 9, enabling the exhaust of the centrifugal compressor 4 to be in a fully-open state, and adjusting the circulating water temperature of the heat exchanger. After the surface temperature of the back plate reaches a working condition set value, collecting total pressure, static pressure and average temperature measurement points of the inlet pipeline 2 on the test bench; the total pressure, static pressure and average temperature parameter measurement points at the outlet; the wall surface temperature measuring point 41 at the axial outlet of the centrifugal compressor 4; and the rotating speed measuring point 61 at the main shaft inlet of the speed regulator 6, a blade surface temperature measuring point and (the front end of the turbine back disk temperature simulator 5) back plate measuring point and other sensors (zero position) output, and confirming that all signals of the test bench device are normal.

Step 2: starting the speed regulator 6, regulating and controlling the rotating speed of the centrifugal compressor 4, synchronously collecting the rotating speed change of the engine, the first group of total pressure, static pressure and average temperature measuring point, the wall surface temperature measuring point 41 on the centrifugal compressor 4, the rotating speed measuring point 61 arranged at the main shaft of the speed regulator 6, and the second group of total pressure, static pressure and average temperature parameter measuring points, and obtaining the transient aerodynamic characteristics and the internal flow field of the centrifugal compressor 4 under the variable working condition of the engine.

Step 3: adjusting the position, corresponding to the set working condition, of the exhaust valve 9 to adjust the flow of the centrifugal compressor 4, and repeating the steps 1 and 2 to obtain the aerodynamic characteristics and the internal flow field of the centrifugal compressor 4 under different flow and rotating speeds.

The centrifugal compressor 4 is a core component of the test bench, the flow meter 1 and the air inlet rectification system 3 are arranged in front of the centrifugal compressor 4, and the flow meter 1 is located at the foremost end of the inlet pipeline 2. The inlet pipeline 2, the air inlet rectification system 3 and the centrifugal compressor 4 are sequentially connected through flanges. The outlet pipeline 8 and the exhaust valve 9 are arranged behind the centrifugal compressor 4, the speed regulator 6 is connected with the impeller shaft end of the centrifugal compressor 4 through a coupler, and the driver 7 provides power for the test bench.

Figure 4:
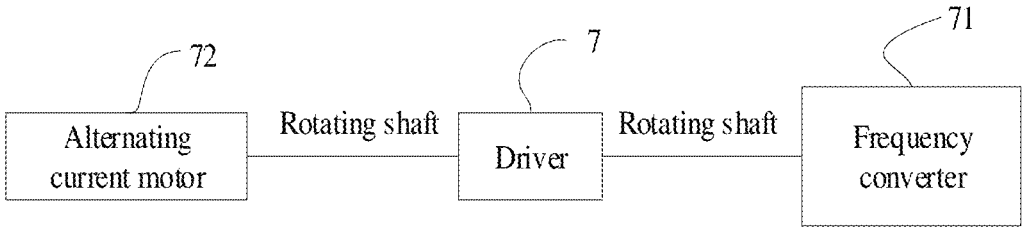
FIG. 4 is a schematic diagram of the driver is coaxially connected to the frequency converter and the alternating current motor in sequence.

In the embodiment, the speed regulator 6 and the driver 7 are composed of the gearbox 63 and a variable frequency motor, and the rotating speed change of the centrifugal compressor 4 can be controlled according to set parameters or rules. As shown in FIG. 4, the motor of the driver 7 is controlled by the frequency converter 71, the rotating speed is fed back through the encoder 62, and the initial rotating speed control precision of the driver 7 is superior to 0.01%. The transmission ratio of the gearbox 63 in the speed regulator 6 is selected according to the rotating speed required by the centrifugal compressor 4, and the transmission ratio of the embodiment is 30:1.

A turbine back disk temperature simulation device (FIG. 2) is arranged between the centrifugal compressor 4 and the speed regulator 6, a through hole 53 is formed in a center of the turbine back disk temperature simulation device for installing a transmission shaft, and meanwhile heat is prevented from being transmitted to the centrifugal compressor 4 through the transmission shaft. High-temperature circulating water is introduced from an inlet end 54 of the heat exchanger and is led out from an outlet end 55 to an external pipeline, and during the experiment, the temperature and the flow rate of the circulating water are controlled, the internal flow channel arrangement of the heat exchanger is changed, and the temperature distribution of the back plate is controlled. The material machining back plate with the same emissivity as the turbine back plate is selected, accurate control over the back plate temperature and the radiation heat exchange amount is achieved, and the turbine back disk flows in the compressor and the heat exchange process at high temperature during actual engine operation are reproduced.

In order to obtain the transient flow field and the heat exchange characteristic in the supercharger transition state compressor under the variable-rotating-speed working condition of the engine, a plurality of parameter testing positions are arranged, for example, a quick response temperature measurement probe and a high frequency porous probe arranged at the parameter measurement point are arranged in the inlet pipeline 2 to measure dynamic total temperature, total pressure and static pressure. The inlet Mach number is calculated to obtain airflow static temperature. A thermocouple array is uniformly arranged on the back surface of the cover plate to capture an internal heat transfer process. The total temperature is a special noun of gas dynamics, which refers to the temperature reflected when the kinetic energy of a fluid is converted into internal energy in an adiabatic process of complete stillness. Calculate the intake Mach number and obtain the airflow static temperature.

During the variable rotating speed process of the engine, transient values of all the parameters in the rotating speed change process are synchronously collected to capture an internal dynamic flowing heat transfer process.

According to the aerodynamic characteristic test platform and test method for researching the centrifugal compressor 4 under the variable working condition of the engine, the rotating speed change of the centrifugal compressor 4 can be accurately controlled according to a specific rule, the temperature of the back plate can be controlled according to the specific temperature distribution characteristics to simulate the influence of radiation heat transfer of the turbine back plate on the transient performance and the internal flow field of the compressor when the supercharger operates, and finally, the typical characteristics of internal flow heat transfer of the centrifugal compressor 4 during the variable rotating speed of the supercharger is reproduced.

What is claimed is:

1. A performance test bench device for a centrifugal compressor under a variable working condition of an engine, comprising: an inlet pipeline, a flow meter, an air inlet rectification system, the centrifugal compressor, an outlet pipeline, an exhaust valve, a gearbox, an encoder, a rotating speed feedback control system, a frequency converter, a speed regulator, a heat exchanger, a thermocouple array, a driver and an alternating current motor, wherein the centrifugal compressor is sequentially arranged coaxially with a turbine back disk temperature simulator, the speed regulator and the driver, and a back plate and the heat exchanger are arranged at a front end of the turbine back disk temperature simulator;

the thermocouple array is arranged on a surface of the back plate, and the thermocouple array is composed of a plurality of pairs of thermocouples;

a total average temperature measurement probe is arranged at an inlet and an outlet of the centrifugal compressor;

the thermocouple array is arranged on a surface of a rotating blade of the centrifugal compressor, and when a test bench device works, an airflow sequentially passes through the inlet pipeline, the flow meter and the air inlet rectification system, is pressurized by the centrifugal compressor, and is then discharged by the outlet pipeline, and an outlet of the exhaust valve is connected to an air outlet end of the airflow;

the speed regulator is composed of the gearbox, the encoder and the rotating speed feedback control system;

the encoder and the rotating speed feedback control system are sequentially connected to a main shaft of the gearbox;

the driver is coaxially connected to the frequency converter and the alternating current motor in sequence; high-temperature circulating water is connected in the heat exchanger; and a through hole is formed in a center of the turbine back disk temperature simulator, and a main shaft of the centrifugal compressor penetrates through the through hole.

2. The performance test bench device for the centrifugal compressor under the variable working condition of the engine according to claim 1, wherein a first group of total pressure, static pressure and average temperature measurement points are arranged in the inlet pipeline;

a second group of total pressure, static pressure and average temperature parameter measurement points are arranged at the outlet of the centrifugal compressor;

a wall surface temperature measuring point is arranged at an axial outlet of the centrifugal compressor; and a rotating speed measuring point is arranged at a main shaft inlet of the speed regulator, and thermocouple array measuring points are arranged on the surface of the back plate.

* * * * *